United States Patent [19]

Layne

[11] Patent Number: 4,851,973

[45] Date of Patent: Jul. 25, 1989

[54] TRACK LIGHTING FIXTURE WITH THERMAL BARRIER

[75] Inventor: Bruce N. Layne, Glendale Heights, Ill.

[73] Assignee: Cooper Industries, Inc., Houston, Tex.

[21] Appl. No.: 161,685

[22] Filed: Feb. 29, 1988

[51] Int. Cl.[4] ..... F21S 1/02

[52] U.S. Cl. ..... 362/147; 362/373

[58] Field of Search ..... 362/147, 148, 149, 294, 362/373

[56] References Cited

U.S. PATENT DOCUMENTS

| | | | |
|---|---|---|---|
| 4,414,617 | 11/1983 | Galindo | 362/404 |
| 4,420,802 | 12/1983 | Smester et al. | 362/148 |
| 4,591,957 | 5/1986 | Harwood | 362/148 |
| 4,688,154 | 8/1987 | Nilssen | 362/147 |
| 4,701,833 | 10/1987 | Bornhorst | 362/373 |

FOREIGN PATENT DOCUMENTS

| | | | |
|---|---|---|---|
| 2153473 | 10/1971 | Fed. Rep. of Germany | 362/294 |
| 8604661 | 8/1986 | Japan | 362/147 |

*Primary Examiner*—Stephen F. Husar
*Assistant Examiner*—Sue Hagarman
*Attorney, Agent, or Firm*—Alan R. Thiele; Eddie E. Scott

[57] ABSTRACT

A thermal barrier is interposed between a lampholder assembly and a plug box assembly in a track lighting fixture.

2 Claims, 2 Drawing Sheets

10
16
19
18
22
20
14
12

TRACK LIGHTING FIXTURE WITH THERMAL BARRIER

BACKGROUND OF THE INVENTION

The present invention relates to lampholders; more particularly, the present invention relates to lampholders usable in track lighting systems.

Track lighting systems have become popular in commercial businesses and in residences whose owners attempt to keep up with the most current decorating trends. One of the more recent developments in such lighting fixtures is the use of compact efficient low voltage light bulbs. The use of these low voltage bulbs has afforded a greater flexibility in design and accordingly has allowed designers of track lighting fixtures a broader range of designs.

While the benefit of the smaller low voltage bulbs has advantages from a design viewpoint, it has disadvantages also. These disadvantages are encompassed in the fact that the line voltage must be reduced to match the lower lamp voltage. This reduction of line voltage usually requires the addition of a transformer (electromagnetic or solid state) near the plug box which mounts the lampholder to the powered track. From a design standpoint, solid state transformers are more desirable for track applications because of their compact size and ability to be put into various shapes. Solid state electronic components which are used to make up the transformer package are normally heat sensitive and could fail prematurely if subjected to high heat conditions.

There is therefore a need in the art to provide a track lighting fixture which protects the sensitive electronic components in the solid state transformer from the heat generated by a lampholder in a track lighting system.

SUMMARY OF THE INVENTION

The improved track lighting fixture of the present invention includes a lampholder assembly wherein a lamp is mechanically mounted and supplied with electrical energy. Additionally, the fixture includes a plug box assembly for mechanically mounting and receiving electrical power from a ceiling mounted power strip or track. Interposed between the plug box assembly and the lampholder is the solid state transformer assembly which is used to step down the line voltage to low voltage. Interposed between the lampholder assembly and the solid state transformer is a thermal barrier. The thermal barrier includes an aesthetically designed heat shield which is formed over the transformer assembly. The layer of insulating air formed under the heat shield works together with the heat shield to protect the sensitive electrical components from the heat generated by the light bulb.

BRIEF DESCRIPTION OF THE FIGURES

A better understanding of the track lighting fixture with thermal barrier of the present invention may be had by reference to the figures wherein.

BRIEF DESCRIPTION OF THE EMBODIMENTS

Figure 2:
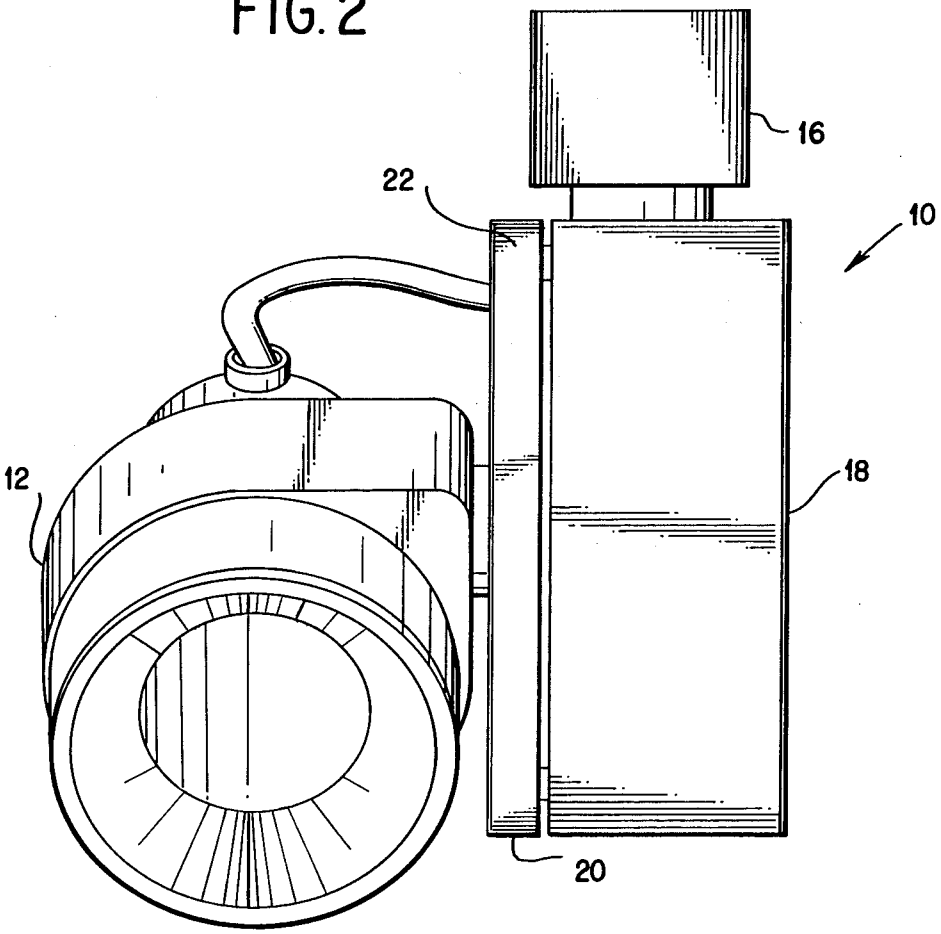
FIG. 2 is a front elevational view of the fixture shown in FIG. 1.
Figure 1:
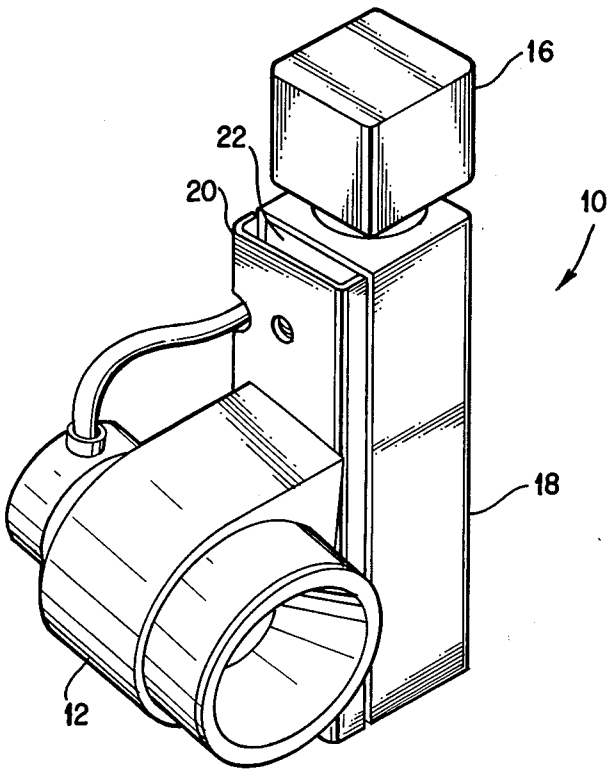
FIG. 1 is a perspective view of a track lighting fixture incorporating the thermal barrier of the present invention.
Figure 3:
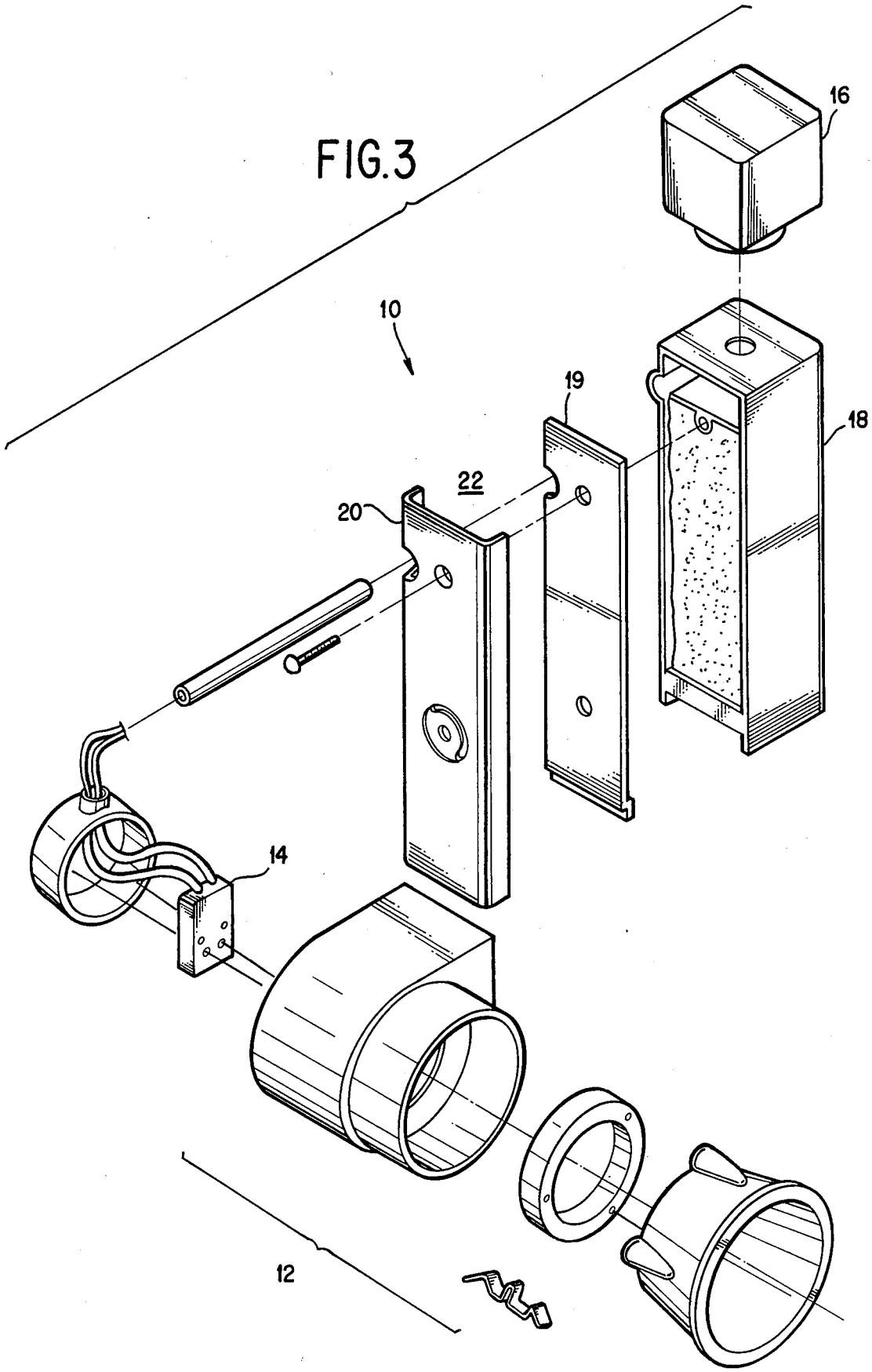
FIG. 3 is an exploded perspective view of the track lighting fixture incorporating the thermal barrier of the present invention.

A better understanding of the track lighting fixture with thermal barrier of the present invention may be had by reference to FIGS. 1–3. Therein it may be seen that the track lighting fixture 10 of the present invention includes the usual lampholder assembly 12 in which a light bulb (not shown) is physically mounted and supplied with electrical energy by a plug connector 14. Additionally, track lighting fixture 10 includes a plug box assembly 16. Plug box assembly 16 forms an electrical and mechanical connection with a section of powered track (not shown). Just below plug box assembly 16 is container 18 with lid 19 for the voltage reduction transformer and associated circuitry. The transformer steps down the power supplied from the track assembly (not shown) to the lamp. This step down of power allows for the use of smaller lower voltage bulbs. The problem associated with prior art fixtures is that the heat generated by the lamp causes the transformer and associated power control components to wear out prematurely.

The heat shield 20 interposed between the solid state transformer and the lampholder assembly 12 solves this problem. By use of heat shield 20 of the present invention, a layer of insulating air 22 is interposed between the lampholder assembly 12 and the transformer and power control circuitry. Together the layer of air 22 and the heat shield assembly 20 form a thermal barrier. Said layer of air may be moving in a convection flow to give a cooling effect. The result is a thermal barrier which has a passive element and an active element. The layer of insulating air is interposed over the power control circuitry and transformer by forming heat shield 20 in a substantially U-shaped manner and using it as a mounting bracket for lampholder assembly 12. The lamp mounting bracket/heat shield assembly 20 may be formed of a die cast metal or it may be fabricated to size using well known machining techniques.

There is thereby provided by the heat shield 20 of the present invention a thermal barrier for protecting the components of the transformer and the associated power control circuitry from the heat generated by the lampholder assembly.

The foregoing embodiment is intended to illustrate the present invention and not to limit it in spirit or scope.

I claim:

1. A fixture for a track lighting system comprising:

means for forming a mechanical and electrical connection to an electrically powered mounting track;

means for mechanically mounting and electrically powering a lamp;

power control circuitry electrically and mechanically connected to said means for forming a mechanical and electrical connection to an electrically powered mounting track and said means for mechanically mounting and electrically powering a lamp;

means for thermally shielding said power control circuitry from the heat generated by said lamp, said means for thermally shielding said power control circuitry including a substantially U-shaped member mounted over said power control circuitry so that the open end of said U is directed toward said power control circuitry, said substantially U-shaped member further allowing for the interposition of a layer of air between said power control circuitry and said lamp.

2. The fixture as defined in claim 1 wherein said power control circuitry includes a transformer.

* * * * *